US005501445A

United States Patent [19]

Lowman et al.

[11] Patent Number: 5,501,445

[45] Date of Patent: Mar. 26, 1996

[54] AUTOMATIC DOCUMENT HANDLER TRAY COVER SYSTEM

[75] Inventors: Michael J. Lowman, Hemel Hampstead; Dennis M. Bendall, Leighton Buzzard, both of United Kingdom

[73] Assignee: Xerox Corporation, Stamford, Conn.

[21] Appl. No.: 371,912

[22] Filed: Jan. 12, 1995

[30] Foreign Application Priority Data

Jan. 18, 1994 [GB] United Kingdom ..... 9400845

[51] Int. Cl.[6] ..... B65H 1/00

[52] U.S. Cl. ..... 271/145; 271/3.01; 355/308

[58] Field of Search ..... 271/3.01, 3.04, 271/3.05, 145, 165; 355/308, 309

[56] References Cited

U.S. PATENT DOCUMENTS

| | | | |
|---|---|---|---|
| 4,231,562 | 11/1980 | Hori | 271/3.04 |
| 4,540,166 | 9/1985 | Massengeil et al. | 271/3.01 |
| 4,721,981 | 1/1988 | Rauen et al. | 355/75 |
| 5,053,814 | 10/1991 | Takano et al. | 271/145 |

FOREIGN PATENT DOCUMENTS

| | | | |
|---|---|---|---|
| 59-167425 | 9/1984 | Japan | 271/145 |
| 60-015332 | 1/1985 | Japan | 271/145 |
| 0162432 | 7/1986 | Japan | 271/145 |

*Primary Examiner*—H. Grant Skaggs

[57] ABSTRACT

A document sheet feeding apparatus 24 for delivering successive documents to an imaging station of a copier 10, including a document input tray 21 for receiving documents to be copied, a cover 44 arranged to be guided between a first position, in which the tray 21 is uncovered, allowing documents to be loaded therein, and a second position in which the cover 44 covers the tray 21. A drive system is provided for automatically driving the cover 44 from the first position to the second position, and a control system 100 controls the drive system so that the cover 44 is automatically driven into the second position prior to a document feeding operation from the tray 21.

9 Claims, 8 Drawing Sheets

AUTOMATIC DOCUMENT HANDLER TRAY COVER SYSTEM

The present invention relates generally to an improved document handler or feeder with a compact automatic cover system which is automatically opened (and closed) at the appropriate times and in an appropriate manner, providing several advantages over prior open or manual closure cover document handlers.

The noise associated with document handlers, particularly recirculating document handlers (RDHs), has been found to be a source of customer dissatisfaction. Noise is associated in particular with airflow, the document sheet acquisition "slap", and sheet impact noise while the sheets are in transport. Historically, the method of reducing the emitted document handler noise has been to add sound deadening material to the inside of the document handler and/or provide a manually operable cover over the otherwise open document tray of the RDH, as in the Xerox Corporation "5047" RDH, and some Eastman Kodak RDHs. Sound deadening reduces some noise, but the remainder of the noise is emitted from the open document loading area, that is, the document input station (tray area) of the RDH. Manual covers are disadvantageous in that they must be manually opened and closed each time a print job document is loaded into or removed from the RDH, and otherwise interfere with document loading and unloading.

Semi-automatic platen covers are known, for different functions in some types of document handlers, as in U.S. Pat. No. 4,721,981, and art cited therein in Cols. 3 and 4, etc..

In a typical document handler of the type often used with image input terminals, such as those used-for providing electronic digital images (e.g., raster input scanners), or, more commonly, those used with light-lens optical imaging systems, documents are sequentially transported from a document input station to an imaging station. In the case of light-lens copiers, this is repeated many times in many recirculations of document sets in an RDH to provide precollated output from the light-lens copier. Some examples of such RDHs are disclosed in Xerox Corporation U.S. Pat. Nos. 5,026,044; 5,062,602; 4,831,419; 4,428,667; 4,469,319; 4,621,801; etc.

As noted, in an attempt to reduce the noise emitted from the document input station, a manual cover has been provided in the Xerox Corporation "5047" copier's document handler. This manual cover can be pulled manually over the top of a document input tray at the document input station. An operator first loads the documents into the document input tray, pulls the cover over the tray and then operates the RDH. After the RDH operation has been completed the cover must be manually pushed back to uncover the tray and allow the unloading of the documents therein. Operators, however, often fail to make use of this cover either because they forget or are so rushed that they perceive its use as a delay, and thus leave it open. Customers thus still complain about the noise coming from the machine during its operation.

One feature of the disclosed embodiment is to provide a document input apparatus such as an RDH in which the cover movement is controllable automatically to ensure that the area above the document input tray is automatically covered during the document feeding operations, when documents are being fed out of and back into the tray. Disclosed is a document input apparatus including a document input tray for receiving documents to be copied, a cover arranged to be guided between a first position, in which the tray is uncovered allowing documents to be loaded therein, and a second position in which the cover covers the tray, with a drive system driving the cover from the first position to the second position, and a control system for controlling the drive system whereby the cover is automatically driven into the second position prior to a document feeding operation from the document input tray, and into the first position after the document feeding is completed.

In the disclosed embodiment the drive system is adapted to drive the cover back and forth between the first and second positions, and, conveniently, the back and forth movement is executed in a substantially horizontal plane. A reversible drive is disclosed for reciprocating the cover between its first and second positions, the cover reaching each of its first and second positions when a respective side edge of the cover abuts against a respective datum surface. The reversible drive may comprise a bidirectional motor. The motor may be adapted to stall when a predetermined overload is encountered. By utilizing a stallable drive system, the need for sensors to sense the cover's position is obviated, and enhanced operation may be provided.

Timing means, associated with the control means, is also disclosed in the embodiment herein. The timing means may energize the drive system for a predetermined period prior to the start of the actual document feeding from the tray, for a period sufficient to ensure that the cover moves from its first position to its second position. The timing means may also energize the drive means for a second predetermined period after the document feeding operation is completed, the second period being Sufficient to ensure that the cover moves from its second position to its first position.

In the disclosed embodiment the drive system includes a belt and pulley arrangement coupled to a drive roller, the drive roller engaging the undersurface of the cover to drive the cover back and forth between the first and second positions. Also disclosed is a shaft associated with the roller which carries a paddle for engaging a projection, carried on the undersurface of the cover, when the cover has reached its second position, the paddle and said projection cooperating to prevent further rotation of the roller after the cover has reached its second position. The paddle on the shaft may also engage a further projection or lip on the undersurface or edge of the cover when the cover has returned to its first position, the paddle and said further projection or lip cooperating to prevent further rotation of the roller after the cover has returned to its first position.

Guide means are disclosed, provided for guiding the cover between its first and second positions. In one embodiment the guide means comprises an elongate guide rail extending parallel and adjacent to one side edge only of the cover.

It is well known and commonplace to program and execute printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, electronic control systems or methods may be implemented partially or fully in hardware, using standard logic circuits or a single chip using VLSI designs.

In the description herein the term "document"or "sheet" refers to a usually flimsy physical sheet of paper, plastic, or other suitable physical substrate for images, whether precut or initially web fed. A job is normally a set of related sheets, usually a collated copy set copied from a set of original document sheets or electronic document page images, from a particular user, or otherwise related.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

The invention will be described further by way of example, with reference to the accompanying drawings, substantially to scale, in which.

Figure 1:
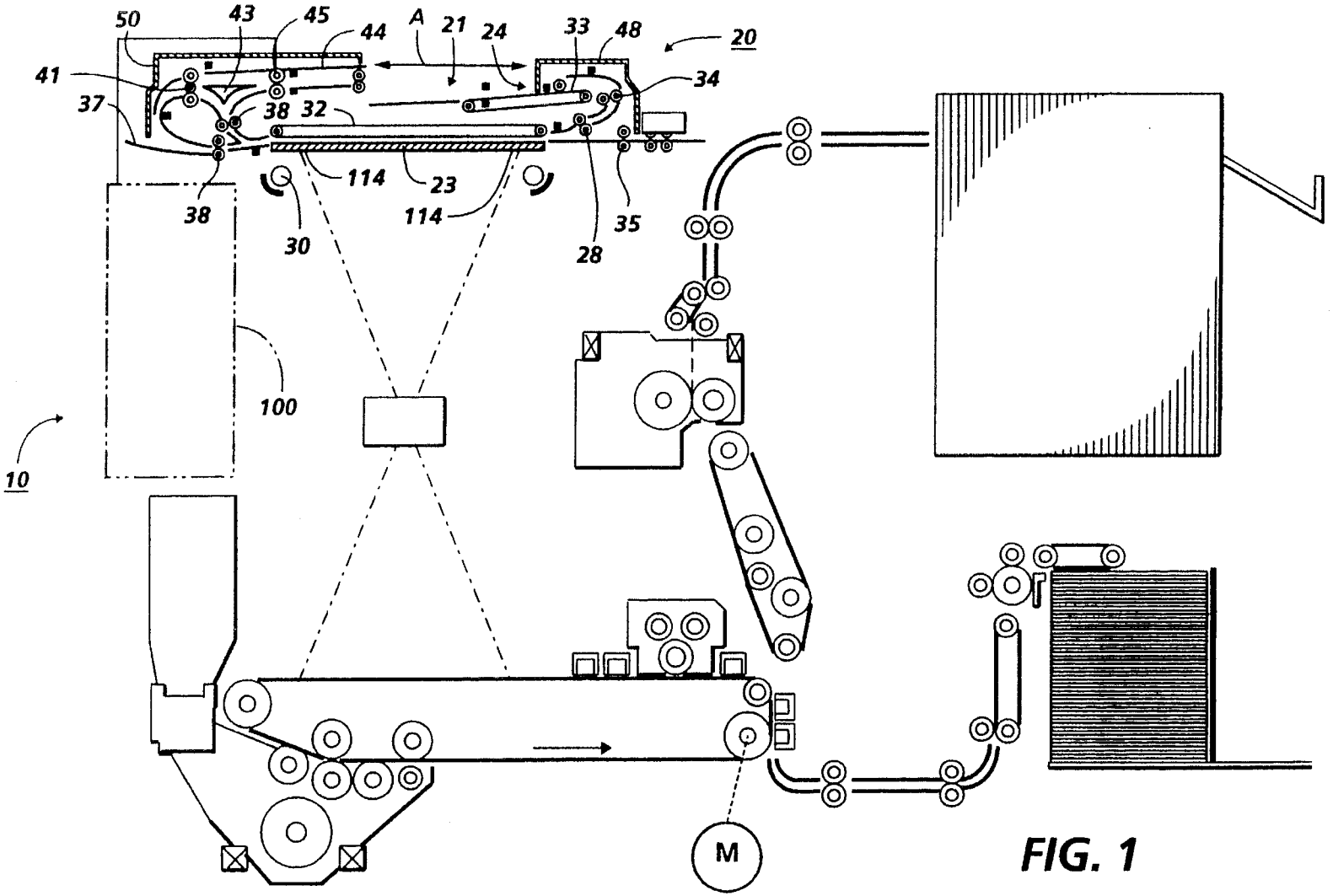
FIG. 1 is a schematic side view of a copier having a recirculating document handler (RDH) with an automatic cover system in accordance with an embodiment of the invention.
Figure 2:
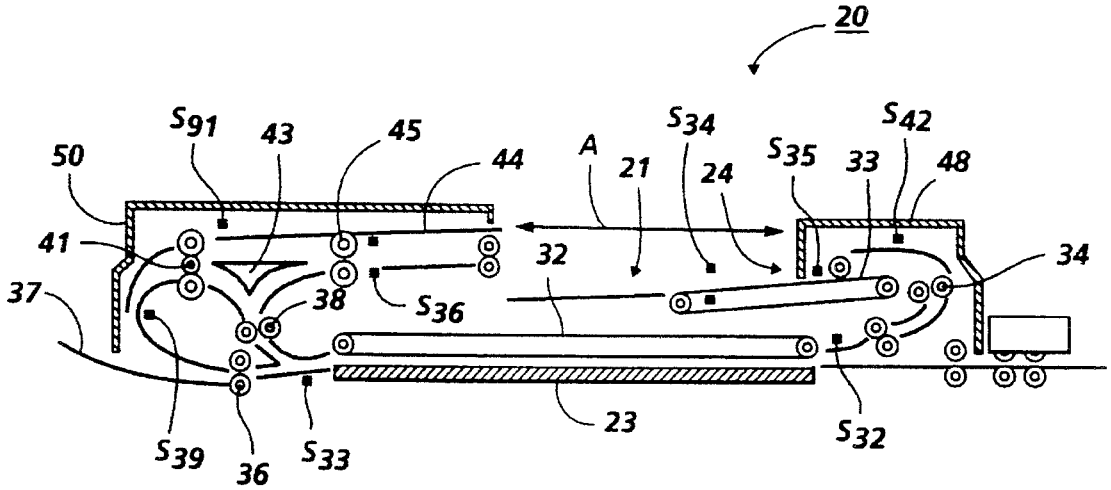
FIG. 2 is an enlarged view of the document handler and cover of FIG. 1, disperse.

FIG. 1 shows a copier 10 with a document handling system 20 having a recirculatory input stacking tray 21, and also a side entrance shelf for a semiautomatic document system into which documents may be individually inserted. Documents inputted from the semi-automatic input are fed through rollers 35 to the platen 23. The recirculating document handler 24 (RDH) of the document handling system 20 is shown in enlarged detail in FIG. 2, and provides for automatically transporting individual registered and spaced document sheets onto and over a conventional platen imaging station 23 of the copier 10, using a friction belt platen transport system 32 overlaying the platen 23. In this example, documents are fed one at a time from the bottom of a stack placed in the tray 21 by a driven belt 33 to a roller set 34 which direct documents to driven rollers 28 and then to the friction belt transport system 32 for imaging. Documents exiting the platen transport system 32 are then directed via a conventional decision gate (not shown) to either the lower two rollers 36 or the rollers 38. Documents fed from the semi-automatic input are directed to an output tray 37 via the decision gate and rollers 36.

Documents inputted from the tray 21 are directed by the gate to the rollers 38 from which they pass via a further decision gate 43 to either a pair of rollers 45 for feeding direct to the tray 21, or, if an inverting operation is required, to the lower nip or pair of the three rollers 41. An inverted sheet can then be passed back to the tray 21 by the upper pair of the rollers 41. As apparent, the described arrangement of rollers provides for both simplex and duplex imaging of documents placed in the tray 21.

A movable cover 44, described in more detail later, is provided to cover the tray 21 during a document handling operation. The cover 44 is mounted in guide means and adapted to be driven automatically back and forth, as indicated by the two-headed arrow A, in a horizontal plane above the document loading area of tray 21. The document handler system has fixed external right and left top covers 48, 50 to cover the moving parts, which covers 48, 50 are substantially contiguous with the cover 44 when it is closed.

The exemplary copier 10 of FIG. 1 is conventional, and need not be described.

Conventionally, as disclosed above, the control of all document placement and feeding is by control unit 100, which is often a programmable microprocessor. A control unit of this type generally controls all functions of document handler system 20, including the means to store and compare documents and copy counts, to recognize jam signals, to implement time delays, and the like, through the control unit 100. Further, the control unit 100 may also control all of the imaging and printing functions and steps of copier 10. A plurality of sensors S32, S33, S35, S36, S39, S42, S91 are shown variously provided in the RDH to detect document jamming, etc.. A sensor 534 is also provided to detect the presence of documents in the RDH and a sensor is provided to count the documents. The outputs from these sensors are coupled to the control unit 100.

Figure 3:
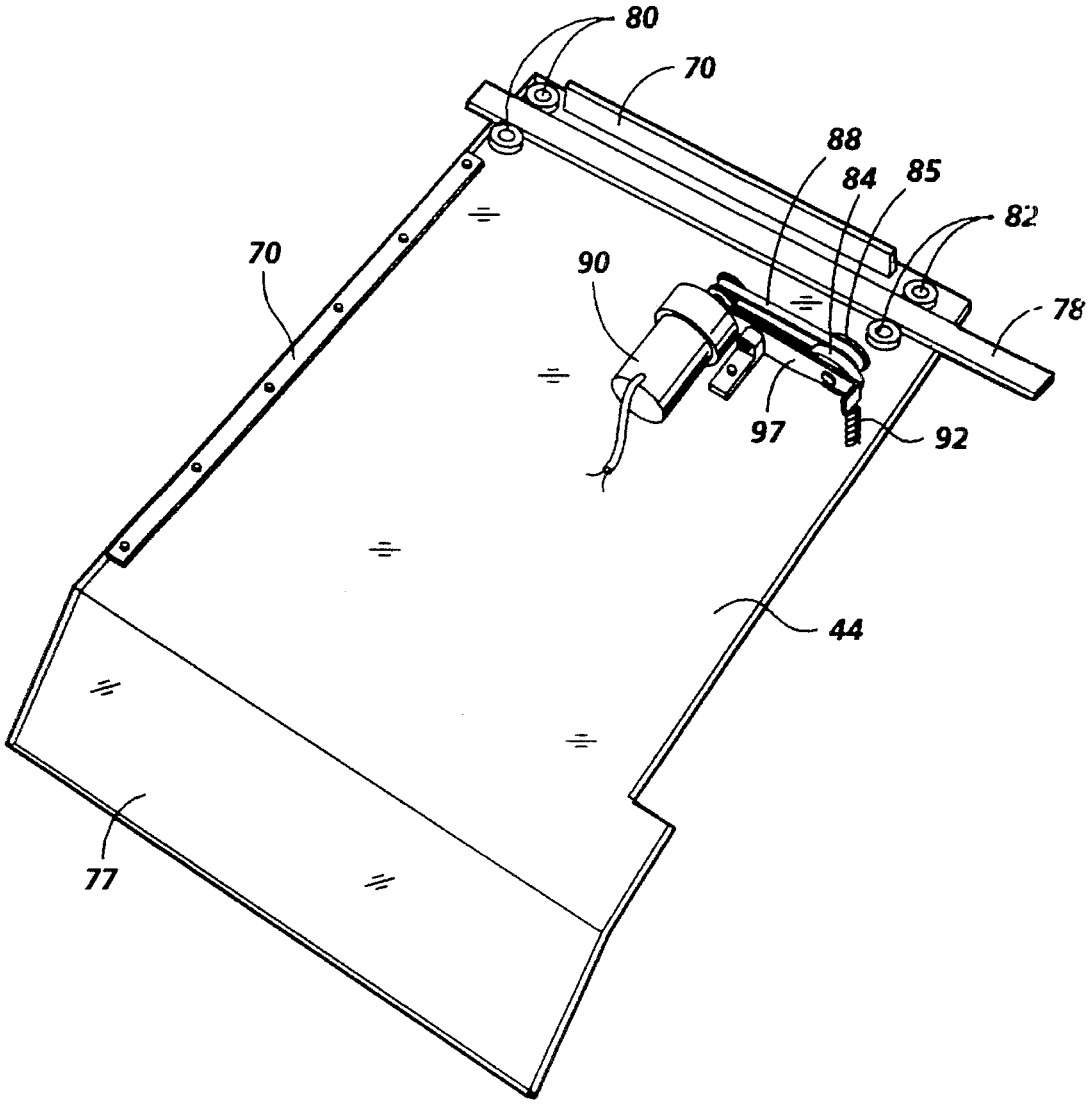
FIG. 3 is an enlarged perspective view in more detail of the cover for the RDH of FIGS. 1 and 2 and an exemplary guide and drive mechanism therefor.
Figure 4A:
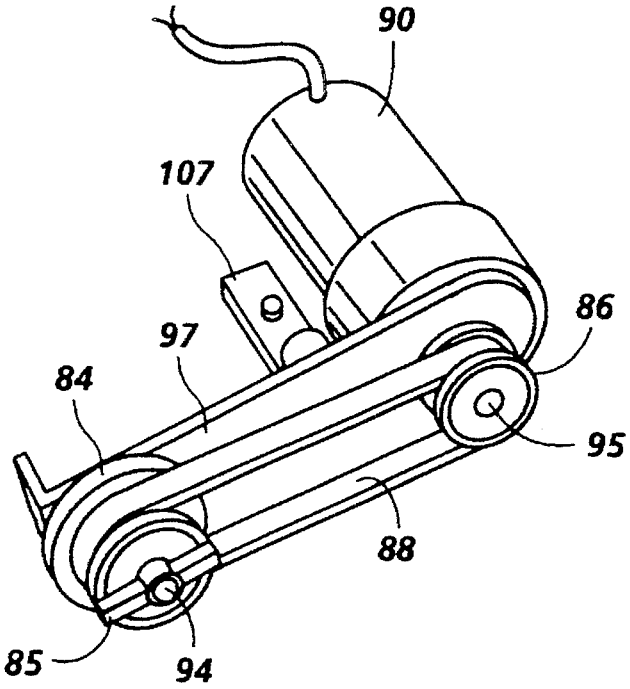
FIGS. 4A and 4B are more detailed illustrations of the cover drive mechanism of FIG. 3, in two different perspective views.
Figure 4B:
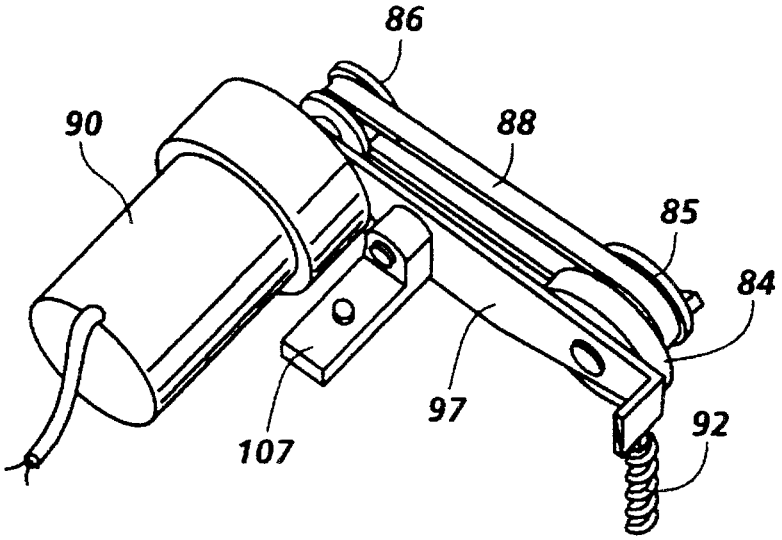
Figure 5:
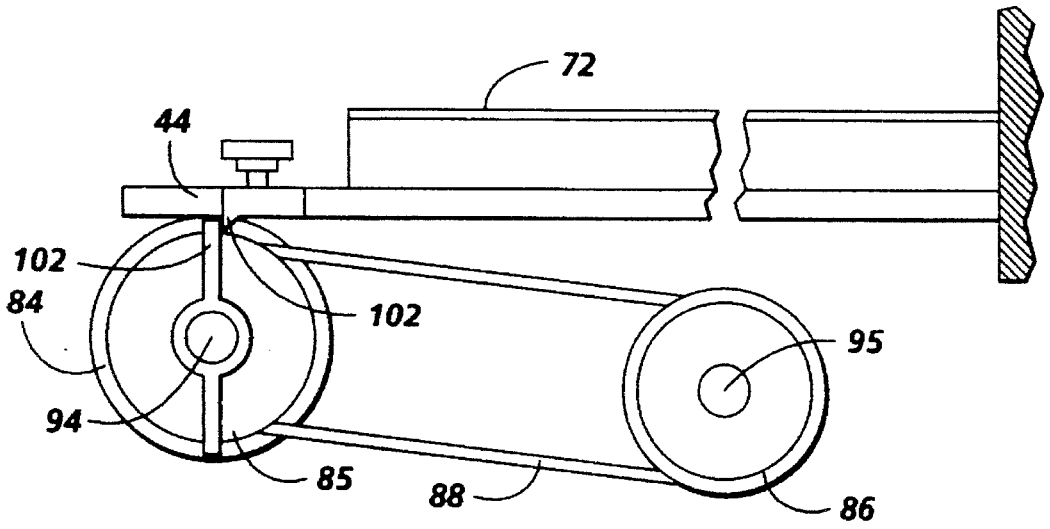
FIG. 5 is a side view of the drive mechanism and the cover in its open position of the embodiment of FIGS. 1–4.
Figure 6:
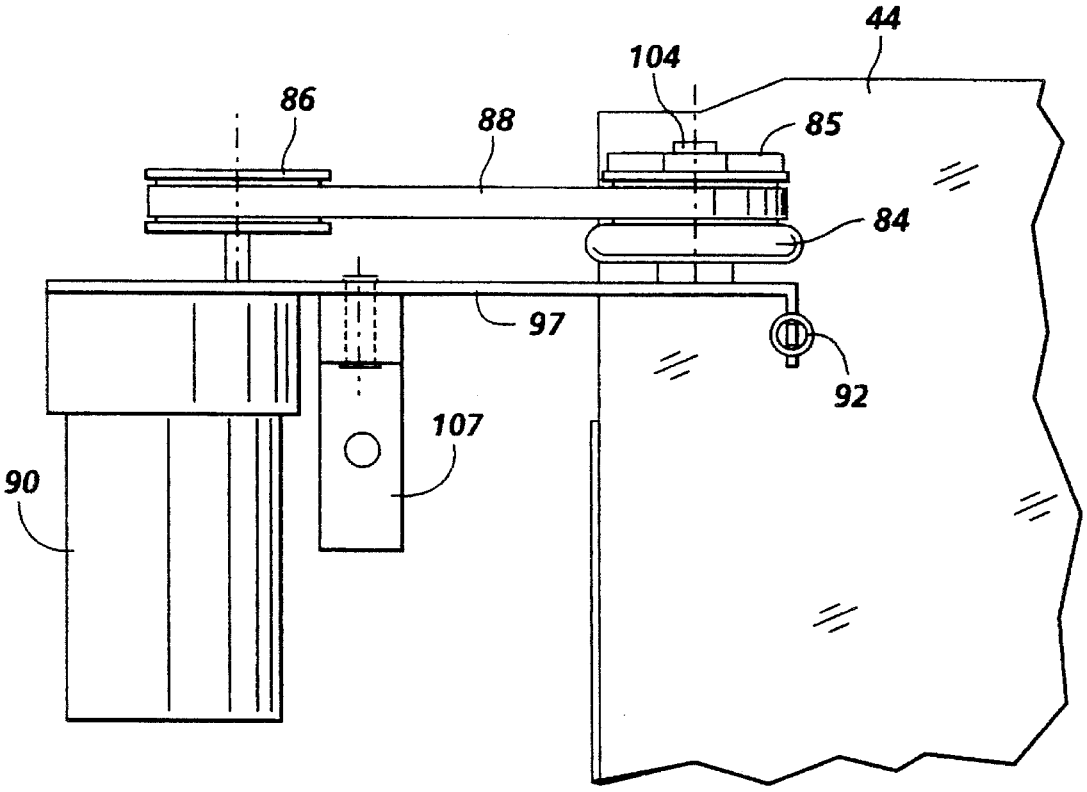
FIG. 6 is a plan or bottom view of the cover and drive mechanism of FIG. 5, showing the cover in its closed position.
Figure 7:
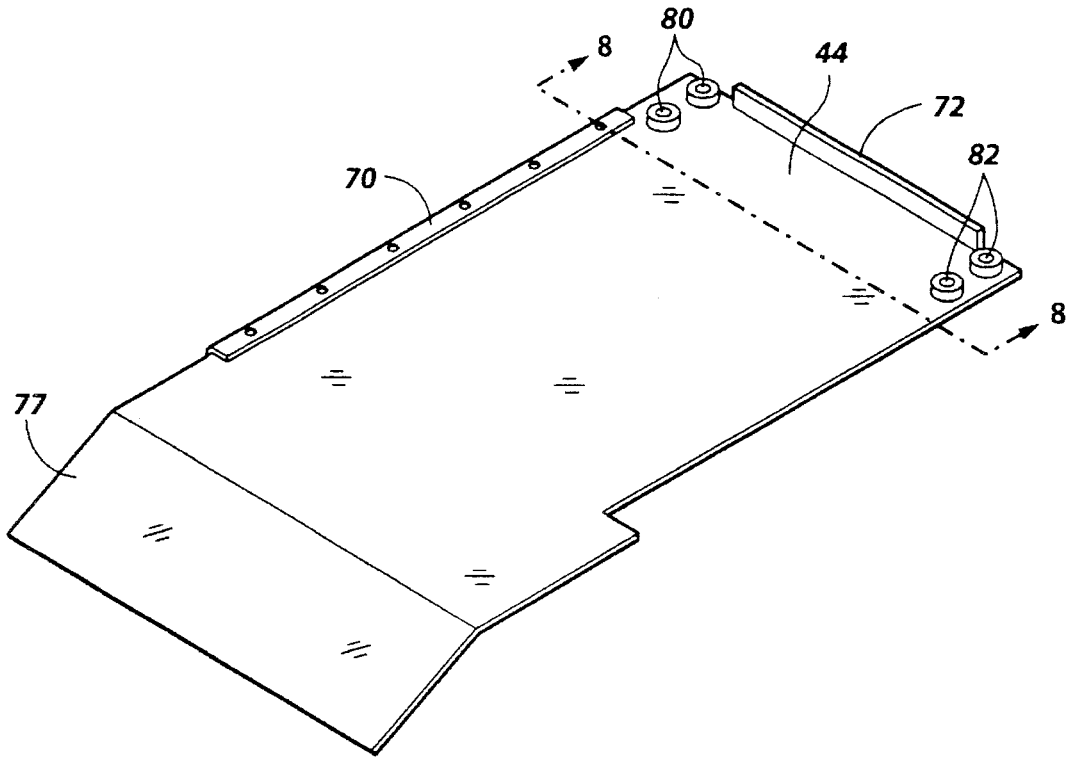
FIG. 7 is a perspective view of the cover per se of FIG. 3.
Figure 9:
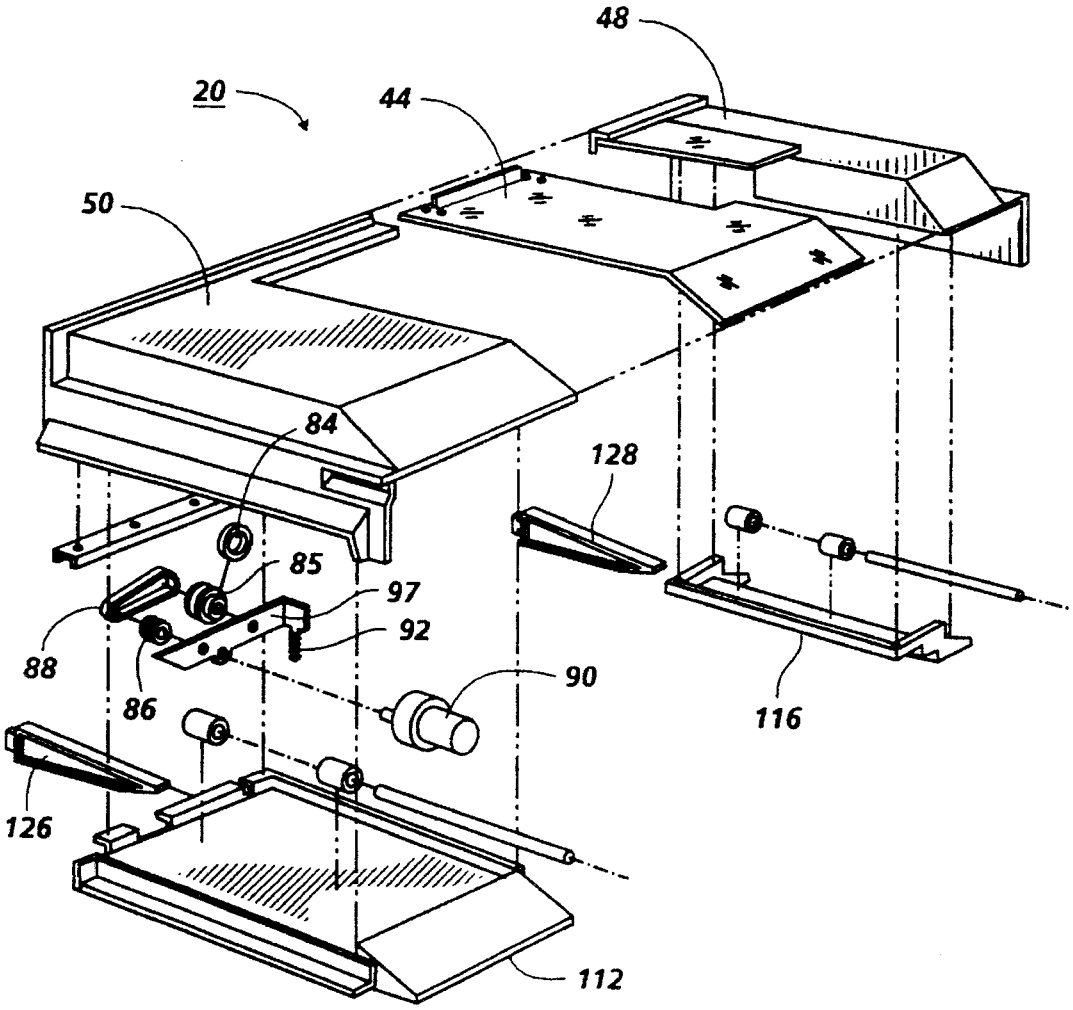
FIG. 9 is a partial exploded view of the recirculating document handler and cover of FIGS. 1–8.

Referring particularly to FIGS. 3, 7, and 9, an arrangement is shown for mounting the cover 44 on the RDH. The cover 44 is provided along an edge with an extension piece 72. The vicinity of the edge having the extension piece 72 is provided with two pairs of spaced rollers 80, 82. The rollers of each pair are spaced to accommodate therebetween an aluminium extruded guide rail or slide 78. The guide rail 78 may be fixed horizontally and parallel to the edge of the cover, with the rollers 80, 82 being in engagement with the sides of the rail 78 for guided movement therealong.

Referring also to FIGS. 4A, 4B, 5 and 6, which show the exemplary cover drive mechanism in clearer detail, movement of the cover 44 is provided by means of a friction roller 84 mounted below the cover 44. The friction roller 84 together with a pulley 85 are coaxially mounted on a shaft 94, the roller 84 engaging with the undersurface of the cover 44. The roller 84 is kept in engagement with the undersurface of the cover 44 by urging means, in the form of a compression spring 92 ( see FIG. 4B). The pulley 85 and roller 84 are mounted to one end of a supporting frame 97, which is itself supported by and pivotally mounted to a bearing block 107. A drive shaft 95 of a bidirectional motor 90 is attached to the other end of the frame 97. The spring 92 is mounted to the end of the frame 97 carrying the roller 84, and urges that end of the frame 97 upwardly, thus forcing the friction roller 84 against the underside of the cover 44. The pulley 85 is itself driven by a belt 88 looped around both the pulley 85 and a drive pulley 86. The drive pulley 86 is mounted to the drive shaft 95 of the bidirectional motor 90 either directly or via a suitable gear train. The motor 90 may have nominal operating conditions of 24 volts DC, 0:3 amps, and 330 revolutions per minute for a load of 0.11 Nm. The motor 90 is selected to stall readily when its driving load exceeds a predetermined value.

An exploded view of the RDH 20 is shown in FIG. 9 and illustrates the cover assembly comprising left hand upper and lower covers 50, 112 and right hand upper and lower covers 48, 116. Pairs of paper feed rollers and their respective shafts are also illustrated, and a pair of mounting brackets 126, 128 for supporting the cover assembly.

In operation, the cover 44 starts (and is normally) in its first or open position, allowing documents to be loaded onto the tray. When the documents have been loaded in the tray 21, the operator presses a conventional start switch or other control to initiate a normal operating sequence which leads to the feeding of the documents to the platen for imaging. This causes the control unit 100 to first transmit an actuating signal to energise the motor 90, which causes clockwise rotation of the drive pulley 86. The circuitry is arranged so that after the start button is pressed the motor 90 is energized to drive for a predetermined period, typically approximately 4 seconds. The clockwise rotation of the drive pulley in turn causes the frictional drive roller 84 to rotate, also in a clockwise direction. The underside of the cover 44 is in frictional contact with the friction roller 84, and it is driven in a horizontal direction over the tray 21 until the forward edge of the cover 44 abuts against an opposite side wall of the right hand cover 48 of the RDH 20, at which point the cover has reached its second or closed position covering over the area above the tray. The cover 44 takes approximately two seconds to move from its open to its closed position. After the cover 44 has reached its closed position, a projection 102 provided on the underside of the cover 44 (see FIG. 5) engages a projecting paddle 104 on the shaft 94 associated with the friction roller 84, thereby preventing the friction roller from further rotation. This in turn causes stalling of the motor 90, which nevertheless may remain energized for the further two seconds. After the total of 4 seconds have elapsed, the control unit 100 transmits signals to start the feeding of the documents from the tray area.

After the RDH 20 operations are completed, the control unit 100 then transmits a further signal to energise the motor 90, but for rotation in the opposite direction. The friction roller 84 now drives the cover 44 back into its first or open position, in approximately 2 seconds. The paddle 104 on the shaft 94 associated with the friction roller then comes into engagement with a further projection or lip on the underside or edge of the cover 44 (like 102), causing the friction roller 80 to stop rotating and causing stalling of the motor 90, which nevertheless remains energised for a further 2 seconds.

In this way, the document loading area is always automatically covered during the document feeding operations, thereby minimizing noise from that area, but the document tray is also always automatically fully exposed for loading and unloading the documents. The need to sense the position of the cover 44 is eliminated by the above drive system, thereby obviating the necessity for cover position monitoring sensors. Furthermore, should an operator inadvertantly place their hand in the way of the cover during its closing operation, the motor 90 will automatically stall with low force, protecting the operator from injury. That is, the cover stops moving whenever a low predetermined resistance is encountered. (As an alternative, or in addition to the stallable motor, a low slippage force may be provided between the roller 84 and the cover 44, as the drive mechanism for moving the cover.

Figure 8:
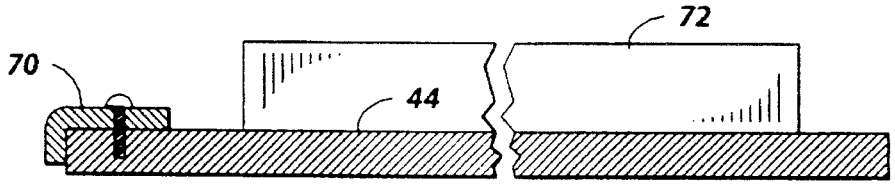
FIG. 8 is a section taken along the line A—A in FIG. 7.

FIGS. 7 and 8 illustrate the exemplary cover 44 in more detail. The cover 44 is preferably thin, e.g., approximately 3 mm thick, and is in the form of a substantially rectangular sheet having a length of approximately 525 mm and a width of approximately 275 mm. The cover may be manufactured from a plastics material, such as polycarbonate, and has its end portion 77 angled downwardly. Along a portion of the rear of the cover 44 is provided an elongate, substantially L-shaped, member 70 which is bolted over the rear edge of the cover 44 to act as a stiffener. An extension member 72 extends along a portion of one side edge of the cover 44.

It will be appreciated that the invention encompasses other embodiments and variations. For example, the embodiment above describes the use of just one guide rail 78, for the purpose of simplicity and cost effective construction. However, it is also possible to use two guide rails each disposed in proximity to respective longitudinal edges of the cover 44. Also the drive mechanism and friction roller, although described as being mounted below the cover 44, to reduce noise and efficient use of space, could in principle be disposed so that the roller engages the cover along its edge, or top surface. Likewise, alternative drive mechanisms could be utilized for reciprocating the cover, and the design of the cover can take different forms to that described above.

While the embodiments disclosed herein are preferred, it will be appreciated from this teaching that various alternatives, modifications, variations or improvements therein may be made by those skilled in the art, which are intended to be encompassed by the following claims:

We claim:

1. A document sheet feeding apparatus including a document input tray for receiving document sheets to be fed from said input tray to be copied, a cover arranged to be guided between a first position, in which said input tray is uncovered to allow document sheets to be unobstructedly loaded into said input tray, and a second position in which said cover covers said input tray; characterized by a cover drive system for automatically driving said cover from said first position to said second position, and a control system for controlling said drive system so that said cover is automatically driven into said second position starting prior to said document sheets feeding from said tray.

2. The document sheet feeding apparatus of claim 1, wherein said cover drive system and said control system are further adapted to drive said cover into said first position after said document sheet feeding from said tray is completed.

3. The document sheet feeding apparatus of claim 2, wherein said cover and said cover drive system are adapted to automatically drive said cover back and forth substantially horizontally between said first and second positions.

4. The document sheet feeding apparatus of claim 3, wherein said drive system comprises a bidirectional motor.

5. The document sheet feeding apparatus of claim 1, wherein said drive system is adapted to stall with low force when a predetermined resistance is encountered.

6. The document sheet feeding apparatus of claim 1, wherein a time delay is associated with said control system for energizing the drive system at a predetermined time period prior to the start of any document sheet feeding from said input tray, said time period being sufficient to ensure that the cover fully moves from its first position to its second position prior to the start of any document sheet feeding from said input tray.

7. The document sheet feeding apparatus of claim 1, wherein said drive system includes a low force drive motor coupled to a frictional roller, said roller frictionally engaging the undersurface of said cover.

8. The document sheet feeding apparatus of claim 1, further including means for stopping said drive system when said cover has reached said second position.

9. The document sheet feeding apparatus of claim 1 including guide means for guiding the cover between its first and second positions, comprising an elongate guide rail extending parallel and adjacent to at least one side edge of said cover.

* * * * *